US006810612B2

(12) United States Patent
Huang

(10) Patent No.: US 6,810,612 B2
(45) Date of Patent: Nov. 2, 2004

(54) SIGNBOARD STRUCTURE ENABLING QUICK AND DETACHABLE ASSEMBLING OF A FACE PANEL THEREOF

(75) Inventor: Chiao-sheng Huang, Taipei Hsien (TW)

(73) Assignee: Agon-Tech. Corporation, Hsin Tien (TW)

( * ) Notice: Subject to any disclaimer, the term of this patent is extended or adjusted under 35 U.S.C. 154(b) by 56 days.

(21) Appl. No.: 10/234,480

(22) Filed: Sep. 5, 2002

(65) Prior Publication Data

US 2003/0106247 A1 Jun. 12, 2003

(30) Foreign Application Priority Data

Dec. 11, 2001 (TW) ..... 90221601 U
Jan. 23, 2002 (TW) ..... 91200660 U

(51) Int. Cl.[7] ..... G09F 3/04
(52) U.S. Cl. ..... 40/452; 362/240
(58) Field of Search ..... 40/452, 524, 621; 362/240, 241, 252; 24/303

(56) References Cited

U.S. PATENT DOCUMENTS 3,102,314 A * 9/1963 Alderfer ..... 24/303
3,163,949 A * 1/1965 Gley ..... 40/452
4,101,884 A * 7/1978 Benton, Jr. ..... 340/815.75
4,254,453 A * 3/1981 Mouyard et al. ..... 362/240
4,345,308 A * 8/1982 Mouyard et al. ..... 362/332
4,914,731 A * 4/1990 Chen ..... 340/815.45
5,390,093 A * 2/1995 Himeno et al. ..... 362/249
5,555,163 A * 9/1996 Pisani ..... 362/252
5,819,454 A * 10/1998 Rosenitsch ..... 40/452

* cited by examiner

*Primary Examiner*—S. Joseph Morano
*Assistant Examiner*—Lars A Olson
(74) *Attorney, Agent, or Firm*—Bacon & Thomas

(57) ABSTRACT

A signboard structure includes a case and a face panel detachably connected to a front opening of the case by means of magnetic adherence. The case includes a back panel on which a plurality of light emitting elements are arranged to partially expose from through holes correspondingly provided on the face panel. A watertight and dustproof sealing material is applied into the case to seal joints of the light emitting elements and the back panel to protect the light emitting elements against moistures and dust. Magnetic elements are correspondingly provided on a front side of the back panel and a rear side of the face panel at predetermined positions, so that the face panel can be quickly and detachably assembled to the case to show different static pictures and/or texts painted on the face panel.

13 Claims, 12 Drawing Sheets

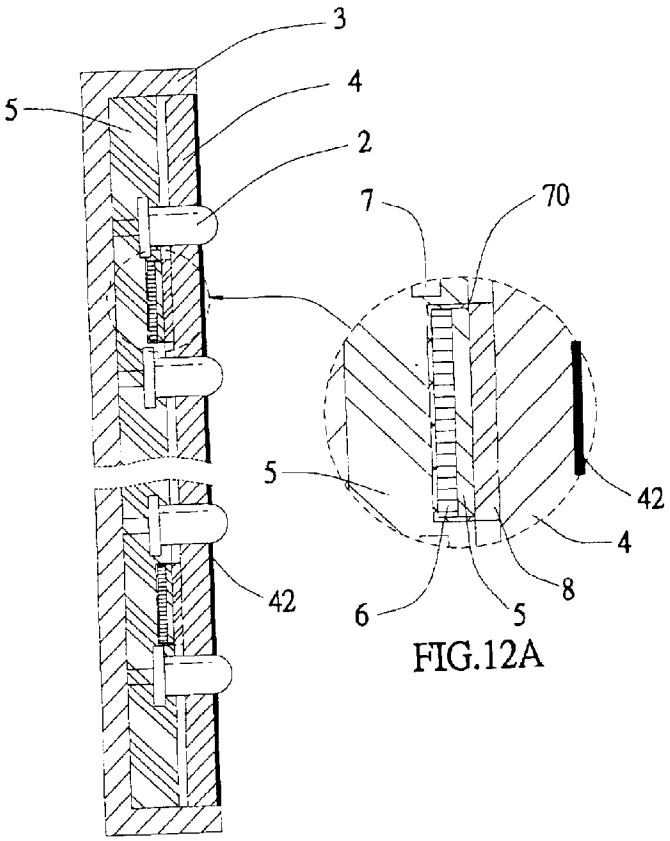
FIG.12A
FIG.12
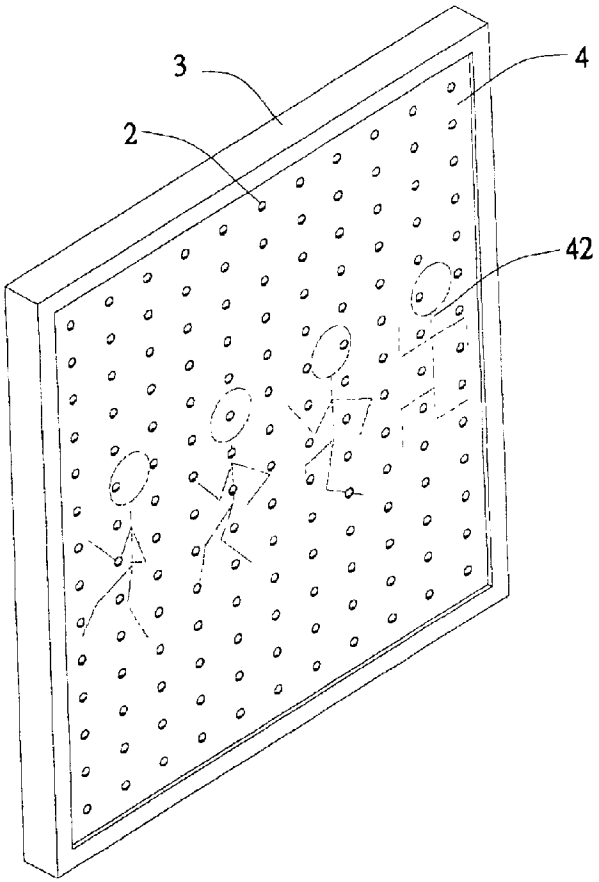
FIG.11

SIGNBOARD STRUCTURE ENABLING QUICK AND DETACHABLE ASSEMBLING OF A FACE PANEL THEREOF

FIELD OF THE INVENTION

The present invention relates to a signboard structure, and more particularly to a structure for quickly and detachably assembling a face panel to a case of a signboard. A plurality of light emitting elements are arranged on a back panel of the case to partially expose from a plurality of through holes correspondingly provided on the face panel. Magnetic elements are correspondingly provided on the case and a rear side of the face panel at predetermined positions, so that the face panel is quickly and detachably assembled to the case by means of magnetic adherence to show different static pictures and/or texts painted on the face panel.

BACKGROUND OF THE INVENTION

Most currently available electronic signboards generally include a big-size panel having a plurality of controllable light emitting elements provided at a front surface thereof. The light emitting elements are electrically connected to emit light via control of various circuits, so as to present desired pictures or texts on the front surface of the panel. Such signboards are usually mounted at high places, such as the front of high-rise buildings located at main road intersections.

However, the light emitting elements for such electronic signboards are directly exposed to external environments. There are not dustproof, wind-tight or watertight structures provided with the signboards to protect the light emitting elements, resulting in a high rate of failure of the light emitting elements. Moreover, light emitted from the light emitting elements on the electronic signboards under the sun is setoff by the sun light, resulting in an inferior visual effect of the signboards.

A second type of very popular advertising signboard is the canvas signboard that provides completely fixed or static pictures and/or texts without any change. Moreover, additional spotlights are needed to illuminate the canvas signboard in the nighttime.

A third type of signboard is the movable signboard that includes a plurality of parallel and turnable bars arranged side by side. Each of these bars has a triangular cross section and therefore has three sides. When all the triangular bars are turned to show the first side thereof, a first static picture or text is presented. And, when the bars are turned to show the second or the third side thereof, another two different static pictures or texts may be selectively presented. That is, the movable signboard can only sequentially present up to three static pictures or texts one by one, and is therefore not so changeful and attractive as compared with the electronic signboard. Moreover, the movable signboard also needs additional spotlights to illuminate the pictures and texts in the nighttime.

A fourth type of signboard is the neon signboard that also provides only limited numbers of changeable pictures and texts and is therefore not so attractive as the electronic signboard. At best it provides changeful pictures and texts in a way similar to revolving lanterns.

In Taiwan Patent application No. 89218561 entitled "Signboard", which is filed by the same inventor of the present invention, there is disclosed an improved signboard structure in an attempt to eliminate the drawbacks existed in the above-mentioned various types of signboards. FIGS. 1 and 2 are assembled sectional view and exploded perspective view, respectively, of the signboard disclosed in Taiwan Patent application No. 89218561. As shown, the signboard includes a case 3 having a back panel 30 and four sidewalls 31 to define a front opening, a plurality of light emitting elements 2 densely arranged on the back panel 30 with a sealing material 5 applied to seal a space between a base portion of the light emitting elements 2 and an inner side of the back panel 30 to prevent moistures and/or dust from penetrating into the base portion of the light emitting elements 2, a face panel 4 mounted to the front opening of the case 3 and provided with a plurality of through holes 41 corresponding to the light emitting elements 2 arranged on the back panel 30 for the light emitting elements 2 to partially expose from the through holes 41. Areas on the face panel 4 that are not provided with through holes 41 may be painted with static pictures or texts, so that these pictures or texts could be clearly seen in the daytime. In the nighttime, the light emitting elements 2 are lighted under control of circuits to present other dynamic pictures or texts on the face panel 4, so that the signboard functions as a television wall or an electronic signboard and is industrially practical for use.

However, it is desirable the face panel of the signboard with static pictures or texts could be securely and detachably mounted to the front opening of the case 3 in an easy and quick manner without the risk of separating from the case, in order to conveniently replace the face panel to show other static pictures and texts.

SUMMARY OF THE INVENTION

A primary object of the present invention is to provide a signboard structure that allows easy, quick, secure, and detachable mounting of a face panel painted with static pictures and texts to a case of the signboard.

Another object of the present invention is to provide a signboard structure that includes a case being provided on a back panel thereof at positions that are not provided with light emitting elements with a plurality of magnetically permeable boxes, in each of which a magnetic elements is sealed with a sealing material applied into the case, such that the magnetic elements are isolated from external environments to well maintain their magnetism to always stably magnetically hold a face panel to the case.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 11 is a fully assembled perspective view of the signboard of FIG. 9;

FIG. 12 is an assembled sectional view of FIG. 11;

FIG. 12A is an enlarged view of the encircled area of FIG. 12 for better showing a structure thereat;

DETAILED DESCRIPTION OF THE PREFERRED EMBODIMENTS

Figure 2:
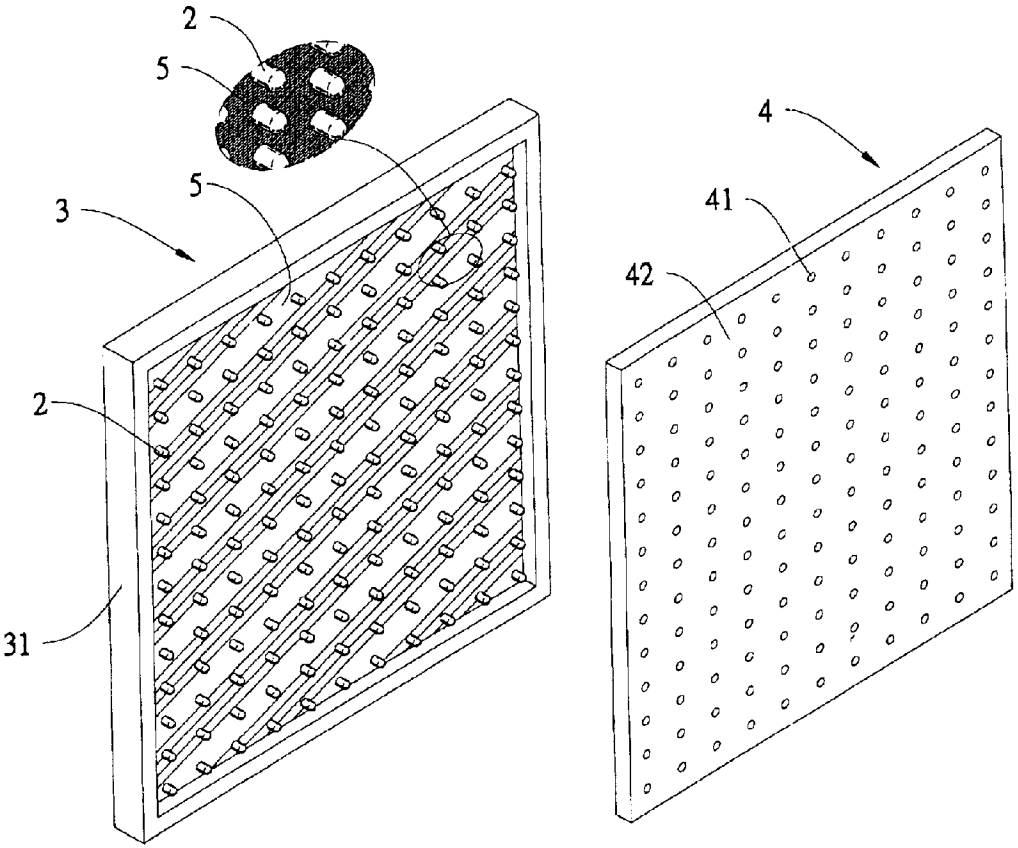
FIG.2 PRIOR ART
FIG. 2 is an exploded perspective view of the signboard of FIG. 1.
Figure 1:
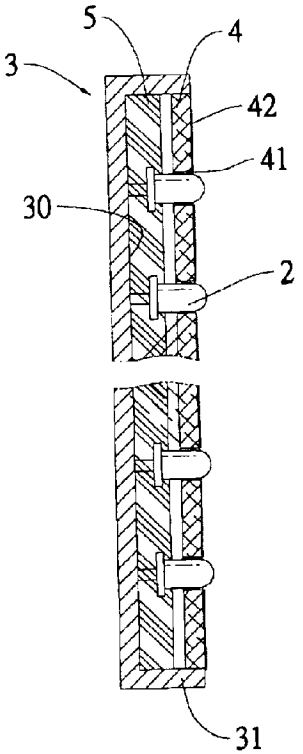
FIG.1 PRIOR ART
FIG. 1 is an assembled sectional view of a conventional signboard.
Figure 3:
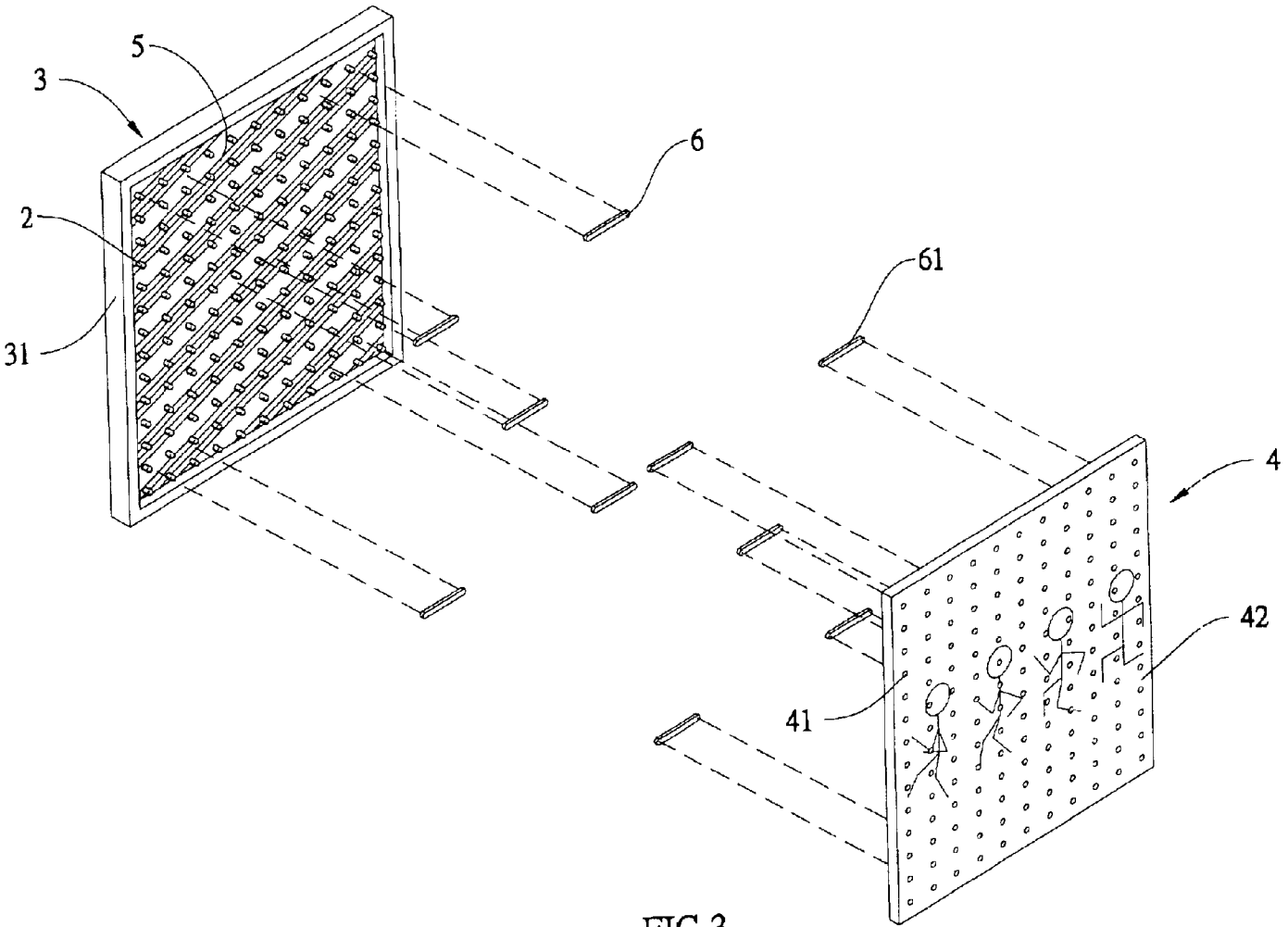
FIG. 3 is an exploded perspective view of a signboard according to a first embodiment of the present invention.
Figure 4:
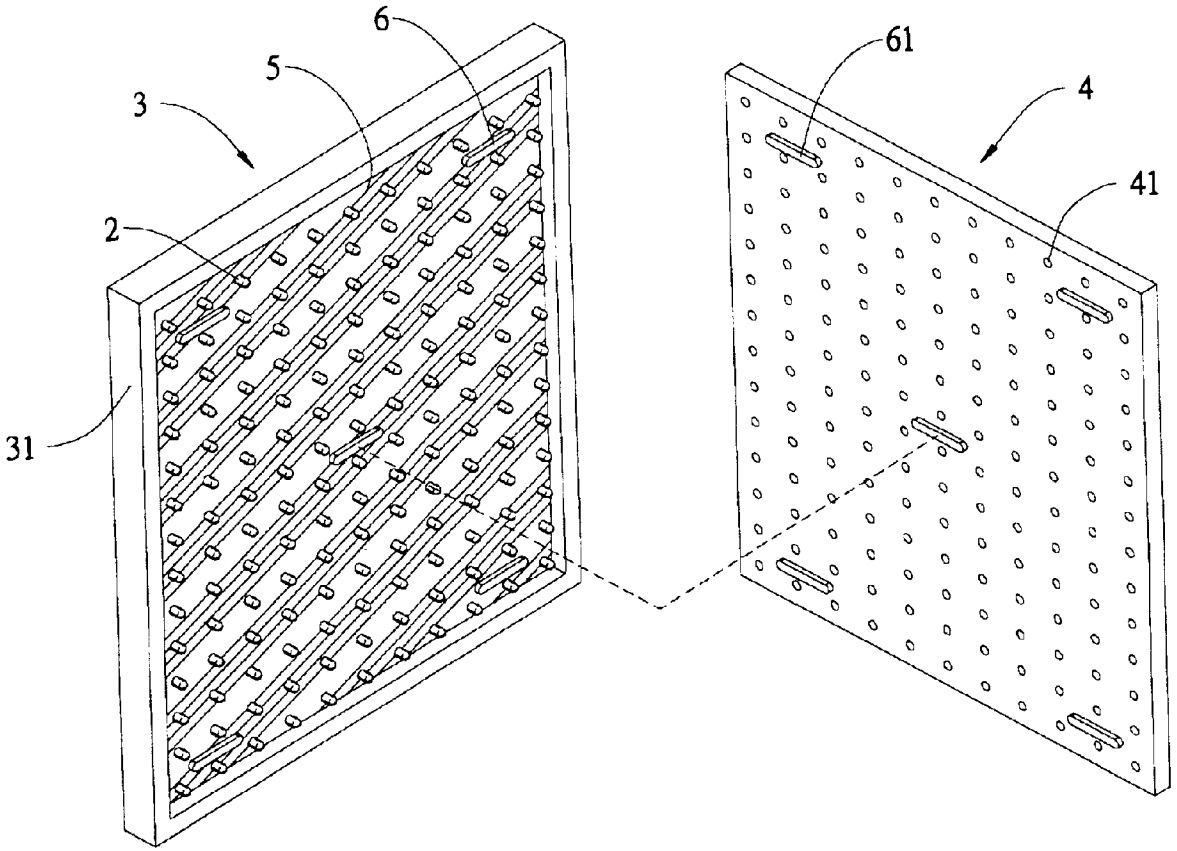
FIG. 4 is a partially assembled perspective view of the signboard of FIG. 3 showing magnetic elements correspondingly provided on back and face panels of the signboard.
Figure 5:
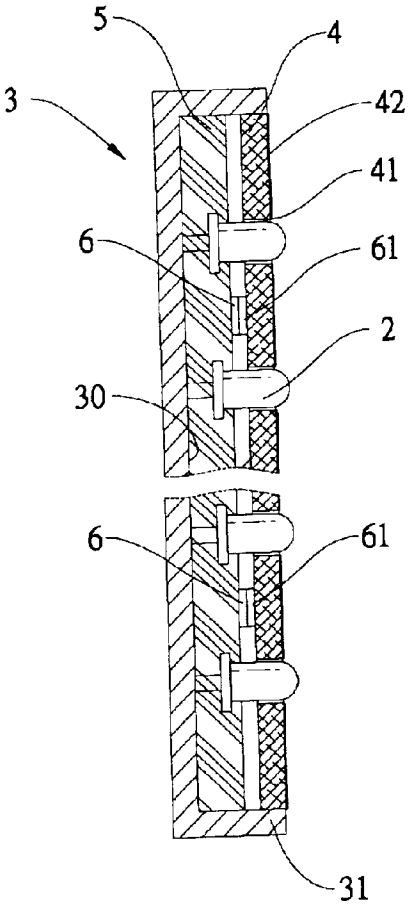
FIG. 5 is an assembled sectional view of the signboard of FIG. 3.

Please refer to FIGS. 3, 4, and 5 which are exploded perspective, partially assembled perspective, and assembled sectional views, respectively, of a signboard according to a first embodiment of the present invention. As shown, the signboard mainly includes a case 3 having a back panel 30 and sidewalls 31 to define an inner space and a front opening; a plurality of light emitting elements 2 densely arranged on a front side of the back panel 30 in a predetermined pattern; and a face panel 4 provided with a plurality of through holes 41 corresponding to the light emitting elements 2 connected to the back panel 30, so that a front portion of the light emitting elements 2 are exposed from the through holes 41; a sealing material 5 applied onto the inner side of the back panel 30 to reach a lower half of heads of the light emitting elements 2, in order to prevent moistures or dust from permeating the light emitting elements 2 via joints of the light emitting elements 2 and the back panel 30 to cause failure of the light emitting elements 2; a plurality of first magnetic elements 61 connected to a rear side of the face panel 4 at positions not provided with the through holes 41; and a plurality of second magnetic elements 6 connected to the front side of the back panel 30 corresponding to the first magnetic elements 61. When the face panel 4 is mounted to the front opening of the case 3, the light emitting elements 2 are allowed to partially expose from the through holes 41. With a magnetic attraction between the first and the second magnetic elements 61 and 6, the face panel 4 can be easily, quickly, securely, and detachably assembled to the case 3 to facilitate convenient replacement of the face panel 4. Pictures and/or texts may be provided on a front side of the face panel 4 at areas 42 other than the through holes 41 to provide static advertising effect.

Figure 6:
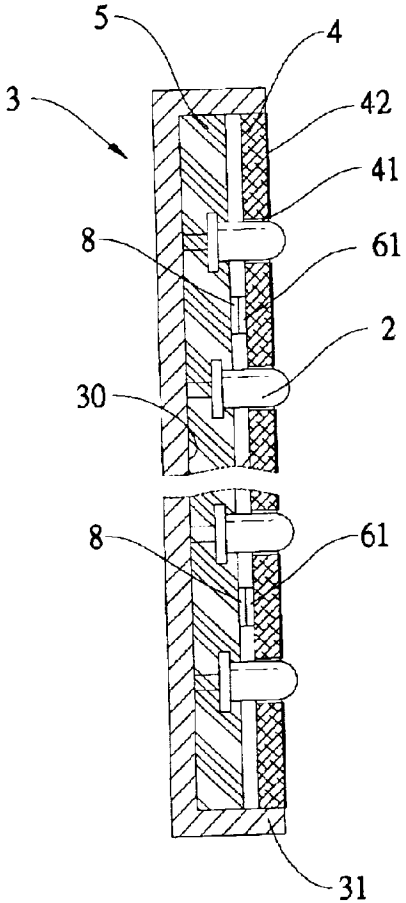
FIG. 6 is an assembled sectional view of a signboard according to a second embodiment of the present invention.

Please refer to FIG. 6 that is an assembled sectional view of a signboard according to a second embodiment of the present invention. As shown, the signboard of the second embodiment is generally structurally similar to the first embodiment, except that magnetically inductive metal elements 8, such as iron elements or any other magnetically attractable metal elements, are used in place of the second magnetic elements 6. Again, when the face panel 4 is connected to the front opening of the case 3 by means of the magnetic attraction between the first magnetic elements 61 and the metal elements 8, the light emitting elements 2 are allowed to partially expose from the through holes 41.

Figure 7:
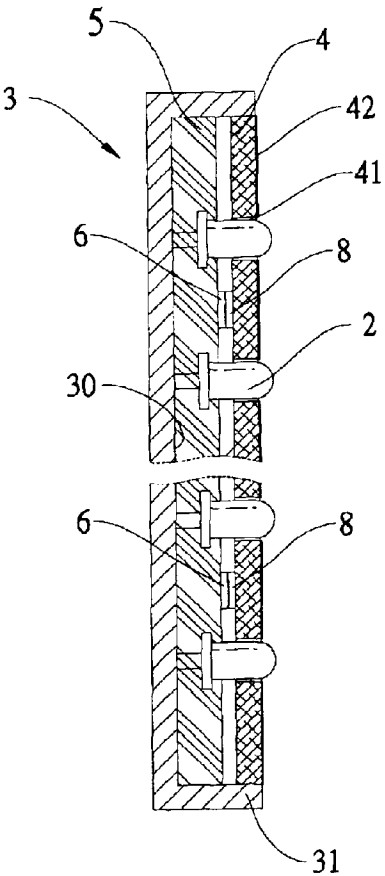
FIG. 7 is an assembled sectional view of a signboard according to a third embodiment of the present invention.
Figure 9:
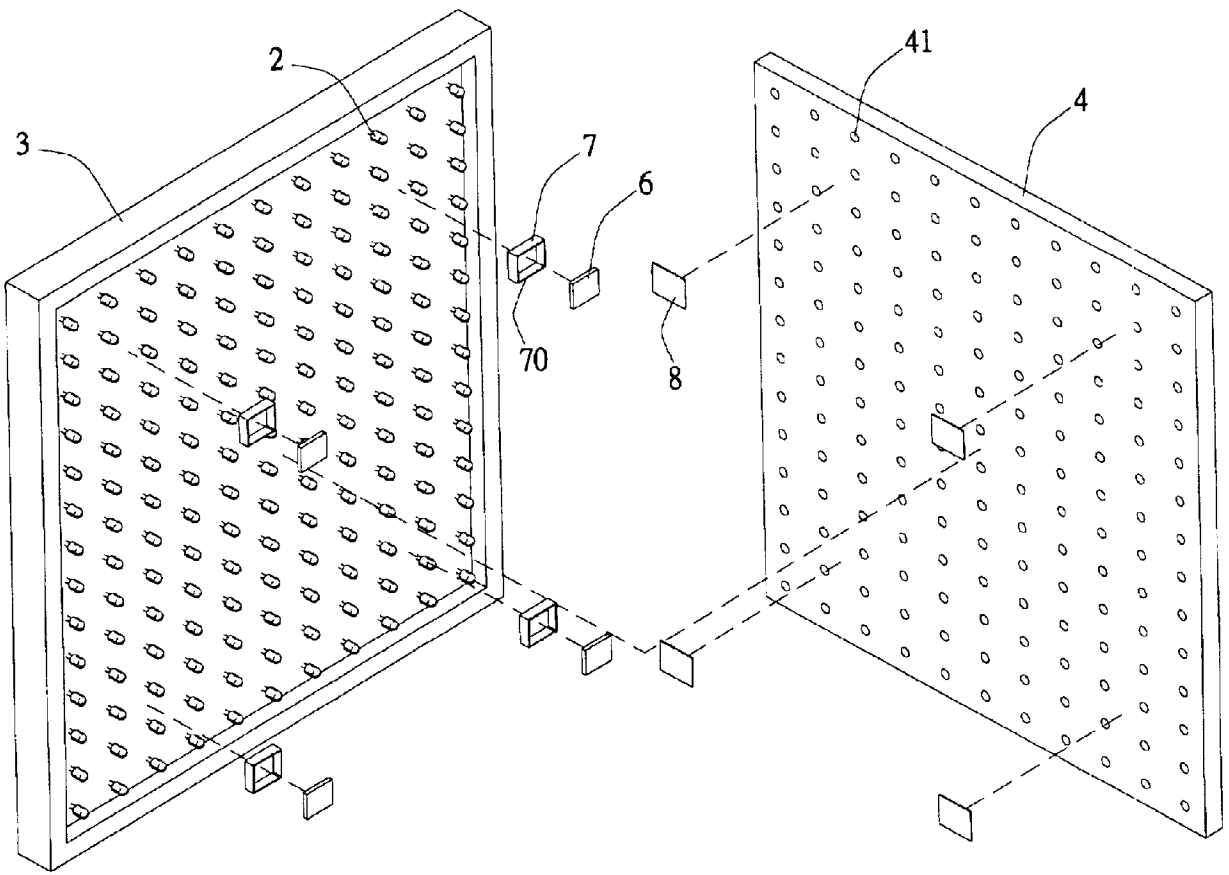
FIG. 9 is an exploded perspective view of a signboard according to a fifth embodiment of the present invention showing that magnetically permeable boxes are additionally provided on the back panel of the case of the signboard.
Figure 10:
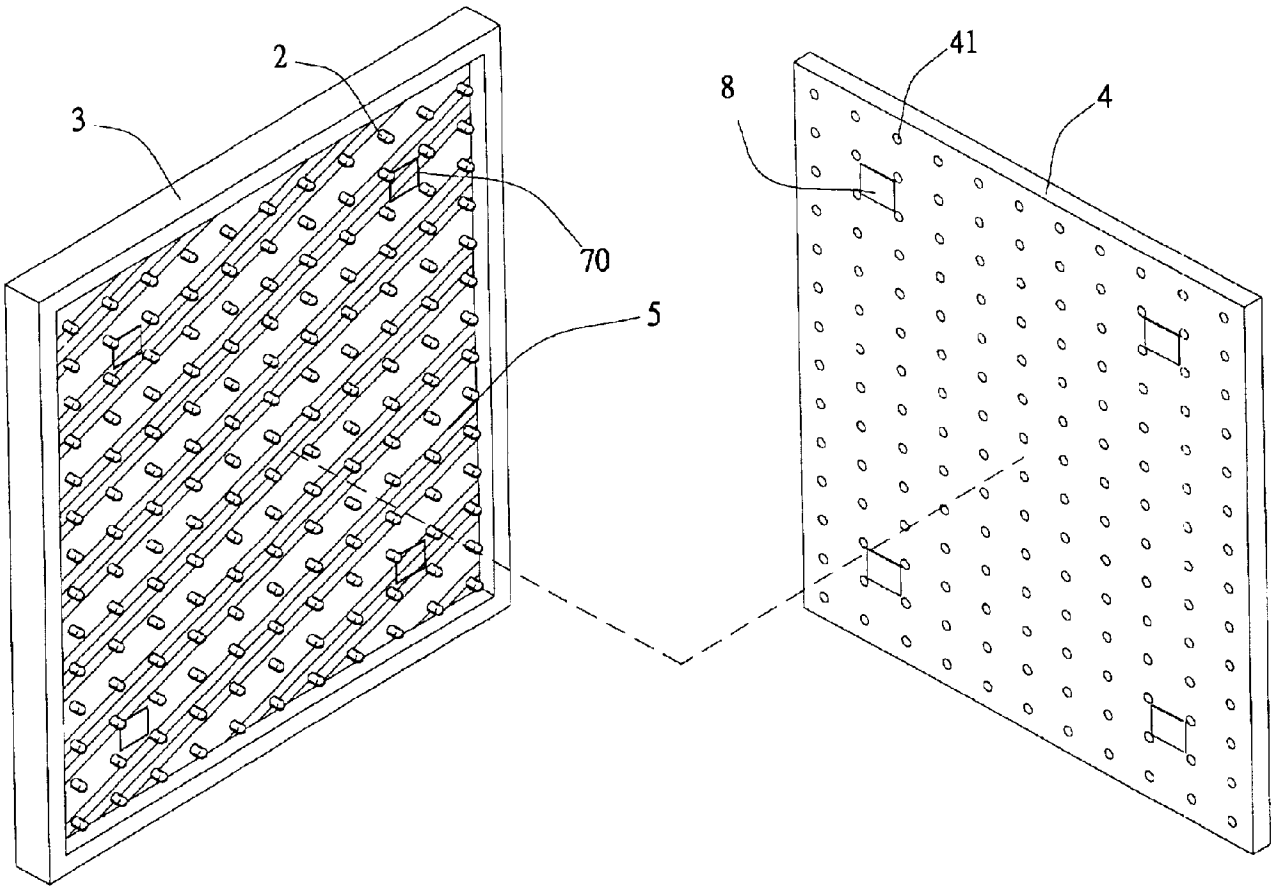
FIG. 10 is a partially assembled perspective view of the signboard of FIG. 9.

FIG. 7 is an assembled sectional view of a signboard according to a third embodiment of the present invention. As shown, the signboard of the third embodiment is generally structurally similar to the first embodiment, except that magnetically inductive metal elements 8, such as iron elements or any other magnetically attractable metal elements, are used in place of the first magnetic elements 61. Again, when the face panel 4 is connected to the front opening of the case 3 by means of the magnetic attraction between the second magnetic elements 6 and the metal elements 8, the light emitting elements 2 are allowed to partially expose from the through holes 41.

Figure 8:
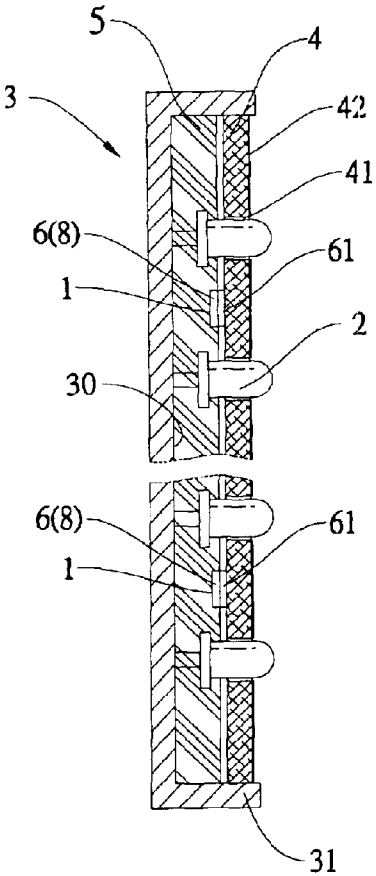
FIG. 8 is an assembled sectional view of a signboard according to a fourth embodiment of the present invention showing magnetic elements thereof are set in recesses provided on a sealing material applied over a back panel of the signboard.

FIG. 8 is an assembled sectional view of a signboard according to a fourth embodiment of the present invention. As shown, the signboard of the fourth embodiment is generally structurally similar to the first or the second embodiment, except that the second magnetic elements 6 or the magnetically inductive metal elements 8 are separately located in a plurality of recesses 1 formed on the sealing material 5 corresponding to the first magnetic elements 61 on the face panel 4, instead of being located at a top surface of the sealing material 5, so that a space between the face panel 4 and the sealing material 5 is reduced to enable more secure connection of the face panel 4 to the case 3. Again, the magnetically inductive metal elements 8 may be iron or any other magnetically attractable material.

Please refer to FIGS. 9, 10, 11, 12, and 12A in which a signboard according to a fifth embodiment of the present invention is shown. The signboard of the fifth embodiment is generally structurally similar to the fourth embodiment, except that a plurality of magnetically permeable boxes 7 are provided on the inner side of the back panel 30 of the case 3 corresponding to the magnetically inductive metal elements 8 on the rear side of the face panel 4 for each receiving one of the second magnetic elements 6 therein. In the fifth embodiment, the sealing material 5 is applied into the space defined by the case 3 to a height to completely cover the second magnetic elements 6. When the sealing material 5 is set, it firmly locates the magnetically permeable boxes 7 in place on the back panel 30, and the second magnetic elements 6 are sealed in the magnetically permeable boxes 7 below the applied sealing material 5. To obtain a visually pleasant front surface of the back panel 30 in the case 3, it is preferable to apply the sealing material 5 into the case 3 to a height equal to upper edges 70 of the magnetically permeable boxes 7. In this manner, only the upper edges 70 of the magnetically permeable boxes 7 are exposed from the sealing material 5 after the magnetically permeable boxes 7 are firmly located in the set sealing material 5. In the signboard of the fifth embodiment, the face panel 4 is also provided with through holes 41 corresponding to the light emitting elements 2 on the back panel 30 of the case 3 for the light emitting elements 2 to partially expose from the through holes 41, and static pictures and/or texts are painted on the front side of the face panel 4 at areas 42 which are not provided with the through holes 41. Moreover, magnetically inductive metal elements 8 are provided at the rear side of the face panel 4 corresponding to the magnetically permeable boxes 7 on the case 3. A magnetic attraction force of the second magnetic elements 6 is transmitted to the magnetically permeable boxes 7, making the latter magnetic members, so that the face panel 4 can be easily, securely, and detachably connected to the front opening of the case 3 through tight magnetic adherence of the upper edges 70 of the magnetically permeable boxes 7 to the magnetically inductive metal elements 8 provided on the rear side, of the face panel 4. The magnetic elements 6, 61 may be magnets, and preferably magnets made of a neodymium alnico material. Moreover, since the second magnetic elements 6 are sealed in the magnetically permeable boxes 7 below the sealing material 5, they are well protected and isolated from external environments to avoid the problem of demagnetization due to oxidation caused by frequent contacting with external environments. Thus, it is possible to effectively and permanently maintain the magnetism of the magnetic elements 6.

Figure 13:
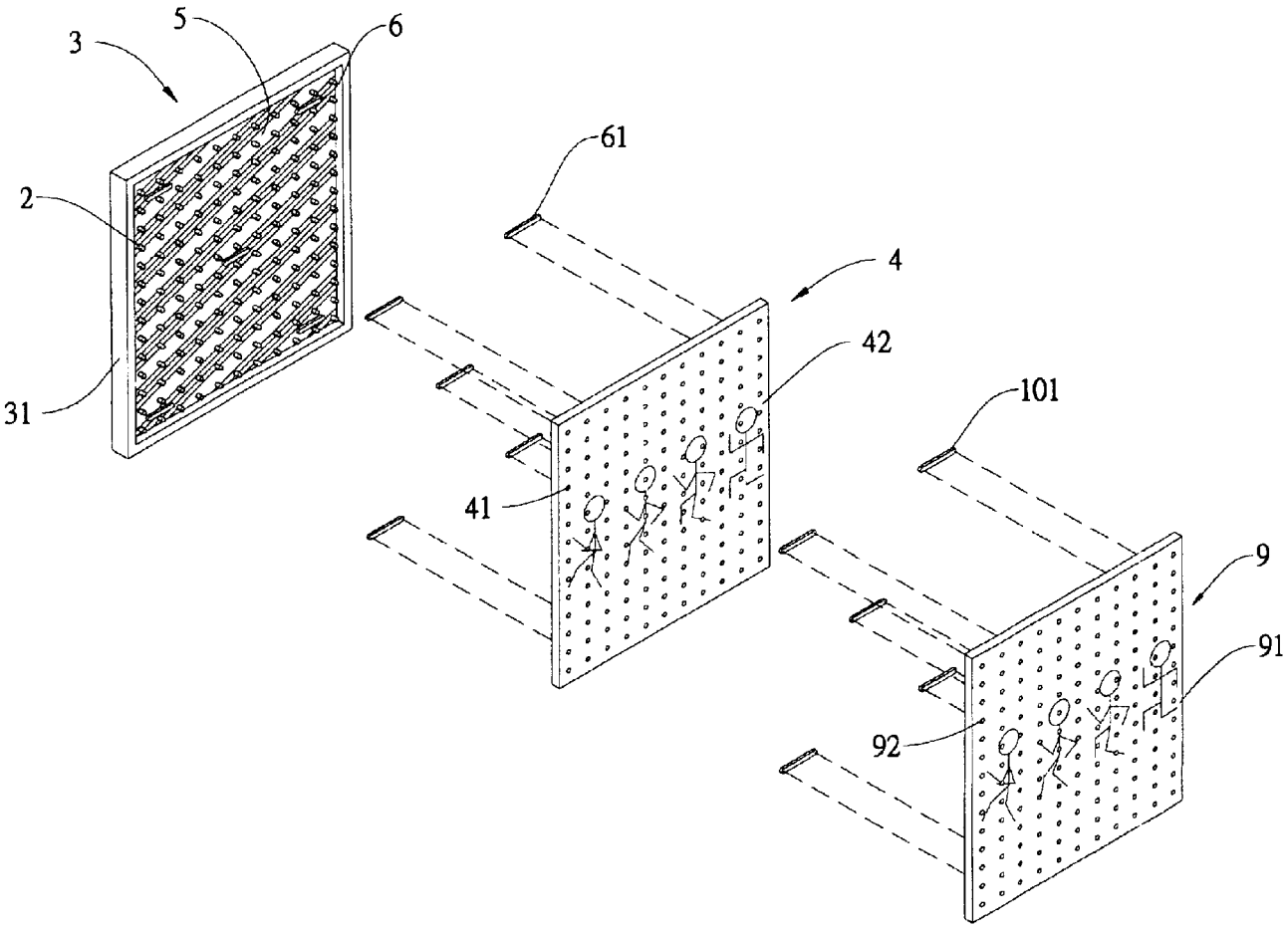
FIG. 13 is an exploded perspective view of a signboard according to a sixth embodiment of the present invention showing a second face panel is attached to a first face panel thereof.
Figure 15:
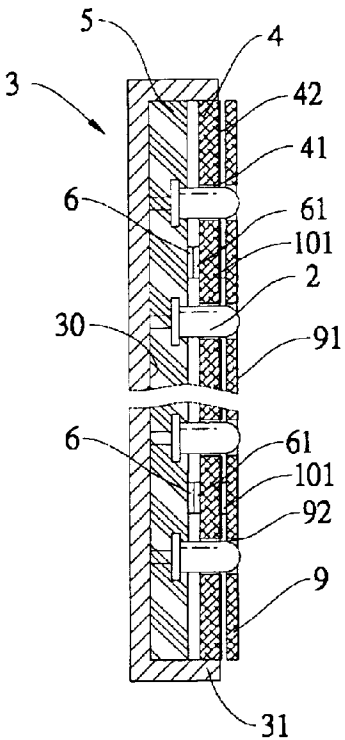
FIG. 15 is an assembled sectional view of the signboard of FIG. 13.
Figure 14:
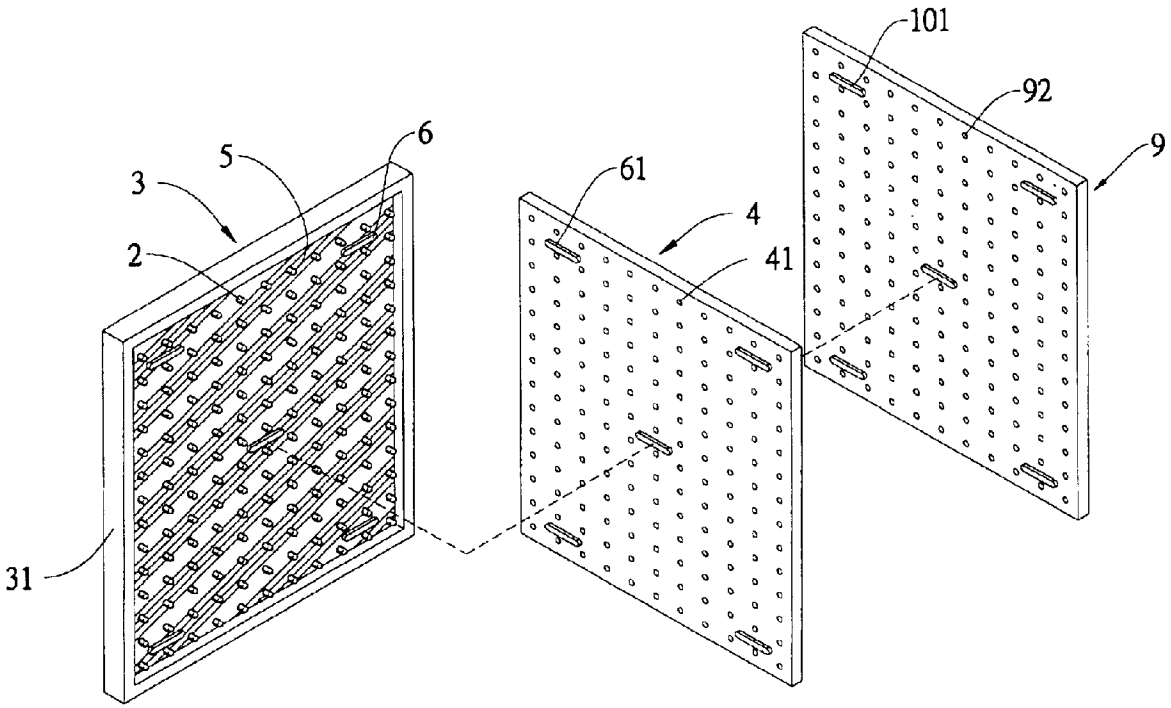
FIG. 14 is a partially assembled perspective view of the signboard of FIG. 13.

FIGS. 13, 14, and 15 are exploded perspective, partially assembled perspective, and sectional side views, respectively, of a signboard according to a sixth embodiment of the present invention. As shown, the signboard of the sixth embodiment is generally structurally similar to the first embodiment, except that a second face panel 9 is detachably attached to the front side of the initial or the first face panel 4. The second face panel 9 is provided with a plurality of through holes 92 corresponding to the through holes 41 on the first face panel 4 for the light emitting elements 2 to partially expose from the through holes 92. Areas 91 of the second face panel 9 that are not provided with the through holes 92 are painted with pictures and/or texts. A plurality of third magnetic elements 101 are provided on a rear side of the second face panel 9 at areas 91 that do not have the through holes 92 to correspond to the first magnetic elements 61 provided on the rear side of the first face panel 4. Therefore the second face panel 9 may be easily, securely, and detachably connected to the front side of the first panel 4 through a magnetic adherence of the third magnetic elements 101 to the first magnetic elements 61. In the same manner, a number of additional face panels may be sequentially detachably attached to a front side of the second face panel 9, so that more pictures and/or texts may be shown and changed in a convenient manner.

Figure 16:
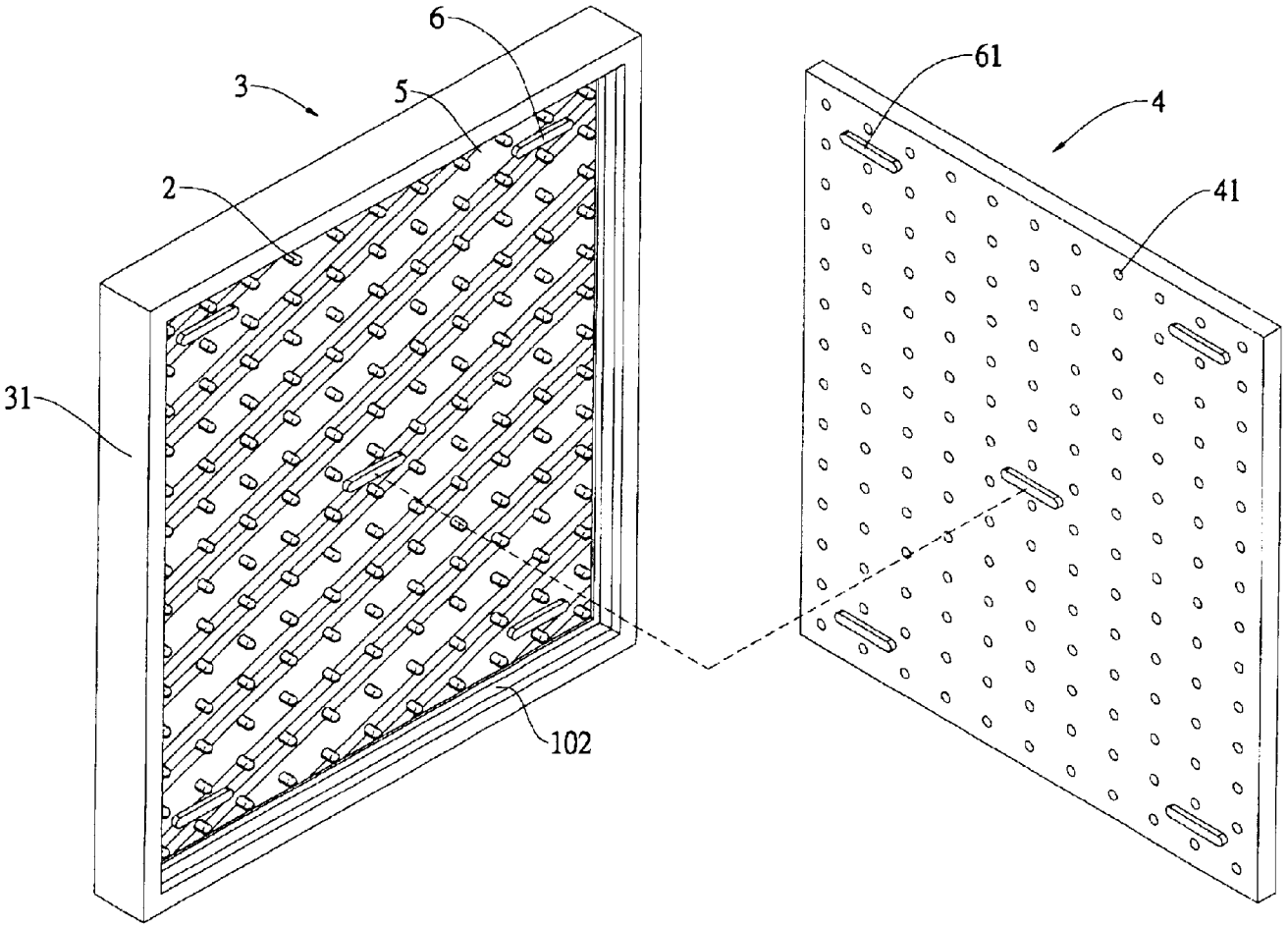
FIG. 16 is a partially assembled perspective view of the signboard according to a seventh embodiment of the present invention showing a case thereof is provided along inner sides of four sidewalls with grooves for connecting a face panel thereto.
Figure 18:
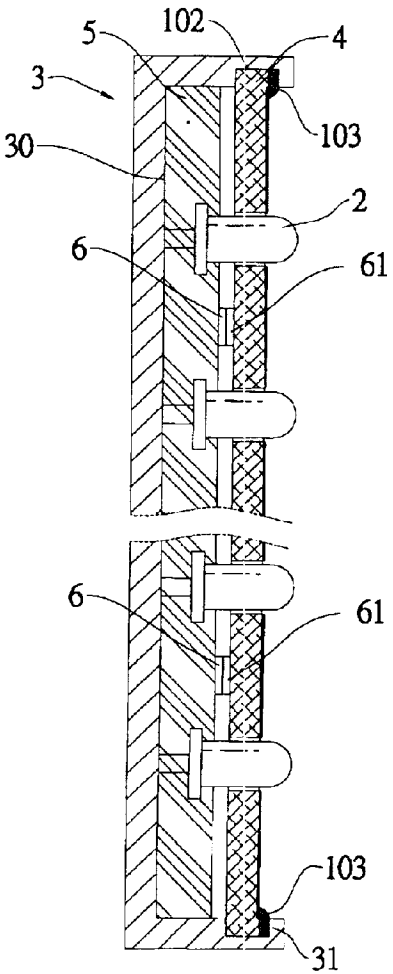
FIG. 18 is an assembled sectional view of the signboard of FIG. 16.
Figure 17:
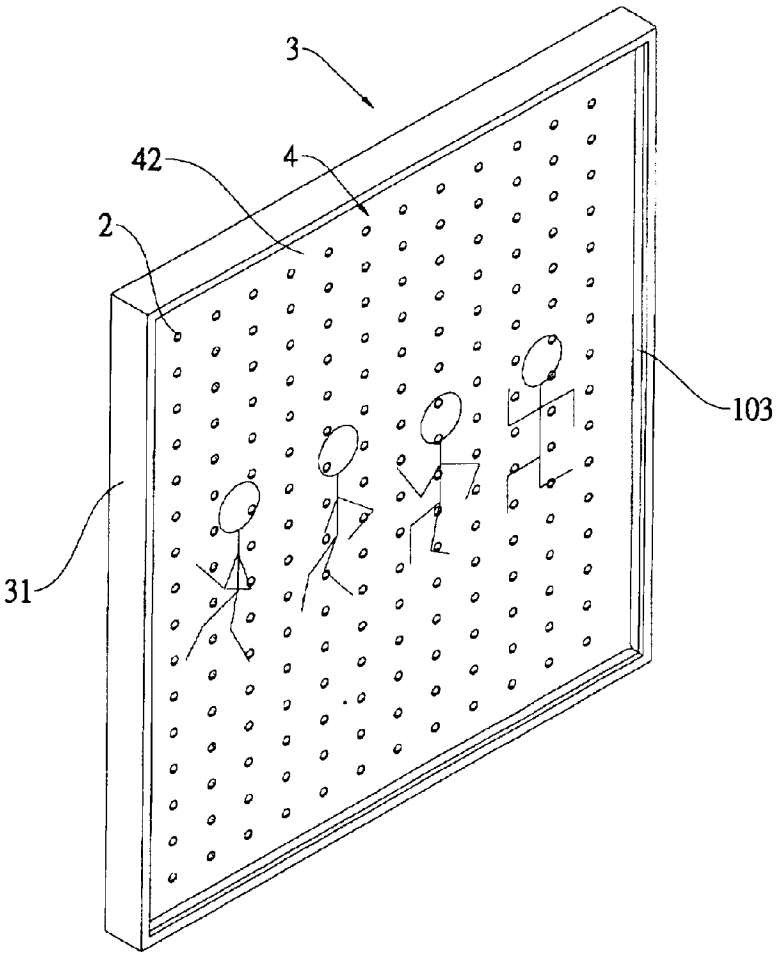
FIG. 17 is an assembled perspective view of the signboard of FIG. 16.

FIGS. 16, 17, and 18 together shows a seventh embodiment of the present invention. In the signboard of the seventh embodiment, the sidewalls 31 of the case 3 are provided at their inner side with a groove 102 for engaging with outer edges of the face panel 4. A caulking material 103 is applied to seal joints of the face panel 4 and the groove 102, so that the face panel 4 is securely connected to the case 3.

The signboard structure of the present invention eliminates problems existed in the conventional signboards while incorporates various advantages thereof to provide superior dustproof, wind-tight, and watertight effect. What is most important is the signboard structure of the present invention enables easy, quick, secure, and detachable connection of the face panel 4 to the case 3, so that the face panel 4 may be frequently conveniently replaced to show different static pictures and/or texts.

In all the previously described embodiments, the face panel 4 is assembled to the case 3 in a detachable and replaceable manner, so that more sets of different static pictures and/or texts could be freely changed and shown. It is understood the face panel 4 is not necessarily removably attached to the case 3 in only the manners described in the previously illustrated embodiments. Any other manner or structure that enables the face panel 4 to associate with the case 3 shall be included in the scope and spirit of the present invention that is intended to be limited only by the appended claims.

What is claimed is:

1. A signboard structure comprising a case having a back panel and sidewalls surrounding said back panel to define an inner space and a front opening, a plurality of light emitting elements arranged on a front side of said back panel of said case in a predetermined pattern, a first face panel attached to said front opening of said case and provided with a plurality of through holes corresponding to said light emitting elements on said back panel for said light emitting elements to partially expose from said through holes, and a sealing material applied into said case to seal joints of said light emitting elements and said back panel of said case; said first face panel being painted on a front side at areas that do not have said through holes with static pictures and/or texts; said signboard structure being characterized in that a plurality of first magnetic elements are connected to a rear side of said first face panel at areas not provided with said through holes, and a plurality of second magnetic elements are connected to the front side of said back panel at areas not provided with said light emitting elements to correspond to said first magnetic elements, whereby said first face panel painted with static pictures and/or texts can be easily, quickly, securely, and detachably assembled to said front opening of said case through a magnetic adherence of said first magnetic elements to said second magnetic elements.

2. The signboard structure as claimed in claim 1, further comprising a second face panel; said second face panel being provided with a plurality of through holes corresponding to said through holes on said first face panel, static pictures and/texts on a front side at areas not provided with said through holes, and a plurality of third magnetic elements on a rear side at said areas not provided with said through holes corresponding to said first magnetic elements on said first face panel; whereby said second face panel is easily, quickly, securely, and detachably assembled to the front side of said first face panel through a magnetic adherence of said third magnetic elements to said first magnetic elements.

3. The signboard structure as claimed in claim 1, further comprising a plurality of magnetically permeable boxes enclosing said second magnetic elements on said back panel of said case; and said sealing material being applied into said case to seal said second magnetic elements in said magnetically permeable boxes, so as to protect said second magnetic elements from oxidation and to maintain a magnetism of said second magnetic elements.

4. The signboard structure as claimed in claim 2, further comprising a plurality of magnetically permeable boxes enclosing said second magnetic elements on said back panel of said case; and said sealing material being applied into said case to seal said second magnetic elements in said magnetically permeable boxes, so as to protect said second magnetic elements from oxidation and to maintain a magnetism of said second magnetic elements.

5. The signboard structure as claimed in claim 1, wherein said first magnetic elements provided on the rear side of said first face panel are magnetically inductive metal elements.

6. The signboard structure as claimed in claim 2, wherein said first magnetic elements provided on the rear side of said first face panel are magnetically inductive metal elements.

7. The signboard structure as claimed in claim 1, wherein said second magnetic elements provided on the front side of said back panel of said case are magnetically inductive metal elements.

8. The signboard structure as claimed in claim 2, wherein said first magnetic elements provided on the rear side of said first face panel are magnetically inductive metal elements.

9. The signboard structure as claimed in claim 1, wherein said sealing material includes recesses provided on an upper surface at positions corresponding to said first magnetic elements for each receiving one of said second magnetic elements therein, so that a space between said first face panel and said sealing material is reduced to enable an even more secure connection of said first face panel to said case.

10. The signboard structure as claimed in claim 1, wherein said magnetic elements are preferably magnets made of a neodymium alnico material.

11. The signboard structure as claimed in claim 2, wherein said magnetic elements are preferably magnets made of a neodymium alnico material.

12. The signboard structure as claimed in claim 1, wherein said case is provided along an inner side of said sidewalls with a groove for engaging with outer edges of said first face panel to ensure a secure and separating-free connection of said first face panel to said case.

13. The signboard structure as claimed in claim 8, wherein a caulking material is applied to joints of said first face panel and said groove.

* * * * *